United States Patent [19]

Schiemann

[11] Patent Number: 4,597,513

[45] Date of Patent: Jul. 1, 1986

[54] POURER PIPE

[76] Inventor: Wolfram Schiemann, Eugen-Nagele-Strasse 17, 7140 Ludwigsburg, Fed. Rep. of Germany

[21] Appl. No.: 633,720

[22] Filed: Jul. 23, 1984

[30] Foreign Application Priority Data

Aug. 5, 1983 [DE] Fed. Rep. of Germany ..... 3328319

[51] Int. Cl.[4] ..... B67D 3/00

[52] U.S. Cl. ..... 222/478; 222/568

[58] Field of Search ..... 222/566, 567, 568, 188, 222/478, 479, 562, 211, 215; 141/98

[56] References Cited

U.S. PATENT DOCUMENTS

| | | | |
|---|---|---|---|
| 227,697 | 5/1880 | Massey | 222/479 |
| 2,785,839 | 3/1957 | DuPree | 222/479 |
| 3,726,964 | 4/1973 | Krejci | 222/566 |
| 3,834,594 | 9/1974 | Schiemann | 222/479 |
| 4,452,381 | 6/1984 | Freeman | 222/566 |

*Primary Examiner*—Joseph J. Rolla
*Assistant Examiner*—Kenneth Noland
*Attorney, Agent, or Firm*—M. R. Kestenbaum

[57] ABSTRACT

A pourer pipe for fitting on a can has a rigid end part which can be introduced into the filler pipe of a motor vehicle tank. The rigid end part is angled and equipped with at least two separate vent passages, making the pourer pipe universally usable for filler pipes which extend approximately vertically and filler pipes which extend nearly horizontally. According to the course of the filler pipe, one of the vent passages acts, as intended, as passage for air moving in the opposite direction.

12 Claims, 9 Drawing Figures

POURER PIPE

The invention relates to a pourer pipe having an outer wall, a rigid, angled end part which can be introduced into the filler pipe of another container, and at least one vent passage in the end part in the region of the outer wall.

BACKGROUND OF THE INVENTION

Pourer pipes of this classification are generally available in commerce. In their case the single vent passage is arranged symmetrically in relation to a plane of symmetry of the pourer pipe and provided in the region of the sector of the outer wall which is remote from the geometrical centre of the crank of the end part. This design is adapted to the long-standing formation hitherto of filler pipes, especially of motor car fuel tanks, in which the filler pipes extended originally vertically and later at an inclination of up to 45° to the vertical. The filter pipes however extend ever more frequently with increasingly acuter angles in relation to the horizontal, which compels introducing the pourer pipe into the filler pipe so that the vent passage lies downwards and thus can no longer fulfill its function.

Since however filler pipes continue to occur in various inclinations, a greater flexibility has been sought in that partially flexible pourer pipes were made. This led to expensive bellows-fold-type constructions unfavourable to production techniques, which moreover have only inadequate wall thicknesses and therefore can easily be damaged. Furthermore, it is very useful if in the case of a can size of above 10 liters a large part of the weight can be supported through the pourer pipe on the filler pipe. Naturally, this possibility does not exist in the case of a flexible pourer pipe.

OBJECT AND STATEMENT OF THE INVENTION

Therefore, the object of the invention is a rigid pourer pipe according to the classification in question so that it is universally usable in combination with filler pipes of all positions. Usability is here understood to mean that the flow-stabilizing function of a vent passage is effective.

This object is achieved by the improvement wherein at least one additional vent passage is formed at least in the angled end part.

Advantageously, the invention includes the following additional features:

The vent passages are arranged at least approximately symmetrically in the pipe cross-section. The advantage is that the can can be tilted up with the pourer pipe equally well to left or right for the purpose of pouring.

Three vent passages are provided. This provides good flow stabilization even when the can is not tilted up vertically.

Four vent passages are provided. This produces good flow stabilization when the can is not tilted up vertically, but in an intermediate position, and renders possible a greater volume of liquid flow.

The vent passages are each formed from a sector of the outer wall and an inwardly domed partition issuing therefrom. The outer surface of the pourer pipe remains smooth and therefore is optically clear and not a dirt trap. Moreover, this represents an optimal exploitation of the cross-section.

The pourer pipe has a plane of symmetry and at least one of the vent passages is arranged symmetrically in relation to the plan of symmetry. When the can is tilted up vertically the maximum possible outflow volume is achieved with the most effective flow stabilization.

The cross-section of each vent passage occupies about 10 to 30% of the pipe cross-section. The cross-section of each vent passage occupies about 15 to 20% of the pipe cross-section. These are expedient proportions of the cross-section of the vent passages in the total pipe cross-section.

The pourer pipe has a securing end lying opposite to the angled end part, which comprises a single-start internal threading for attachment to a pouring spout with corresponding external threading, on a can. The angled end part can assume only the correct position in relation to the can, as soon as the pourer pipe is fixed tightly on the pourer spout of the can.

The pourer pipe has a straight part extending from the bend of the angled end part to the securing end, which has length of about 18 to 22 cm. and the angled end part has a length of about 3 to 7 cm. The straight part has an external diameter of about 3 cm. with an external wall thickness of about 1 to 2 mm. The angled end part has an external diameter of about 2.5 cm. with an external wall thickness of about 1 to 2 mm. The vent passages have partition walls thickness of 0.5 to 1.5 mm. The vent passages extend at least approximately from the outlet end of the angled end part to about 2 to 6 cm. beyond the bend of the angled end part. The pourer pipe has a straight part which is longer than the angled end part, extending from the angled end part at an angle of about 110°. These dimensions for the pourer pipe have proved their value in practice.

The pourer pipe is composed of injection-moulding synthetic plastic material. This is an expedient material and process for the production of the pourer pipe.

DESCRIPTION OF THE DRAWINGS

The invention will be explained in greater detail below with reference to specific embodiments in the specification, taken together with the drawing, where.

DETAILED DESCRIPTION

Figure 1:
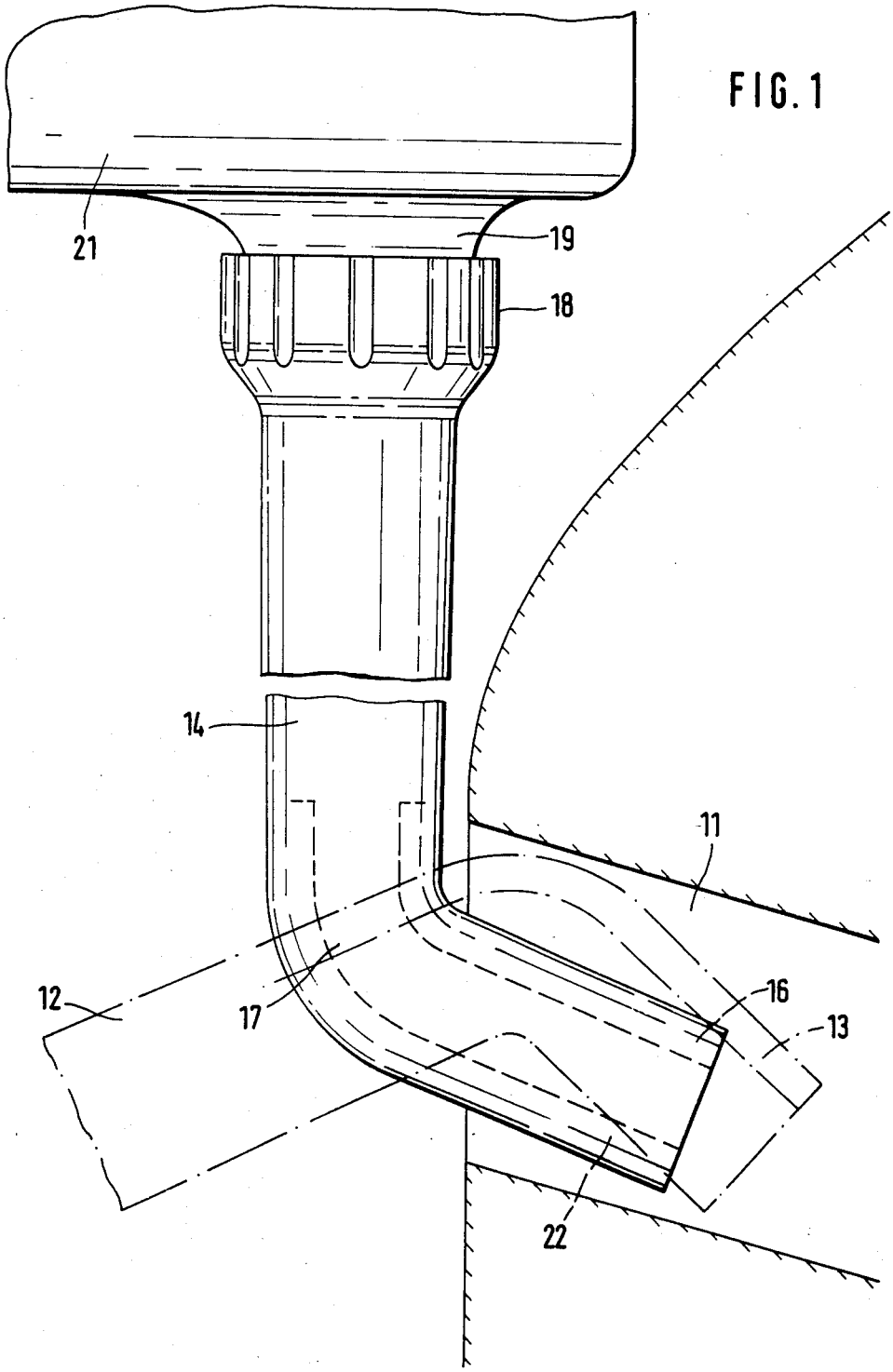
FIG. 1 shows a pourer pipe according to the invention in the position of use.

In FIG. 1 there is illustrated in simplified form a filler pipe 11 for example of motor car. A pourer pipe 12 of conventional construction type is indicated in chain lines and from this it is seen that this cannot be used with such flatly disposed filler pipes, at any rate not in such a manner that then the flow-stabilizing function of the single vent passage 13 remains effective.

Figure 2:
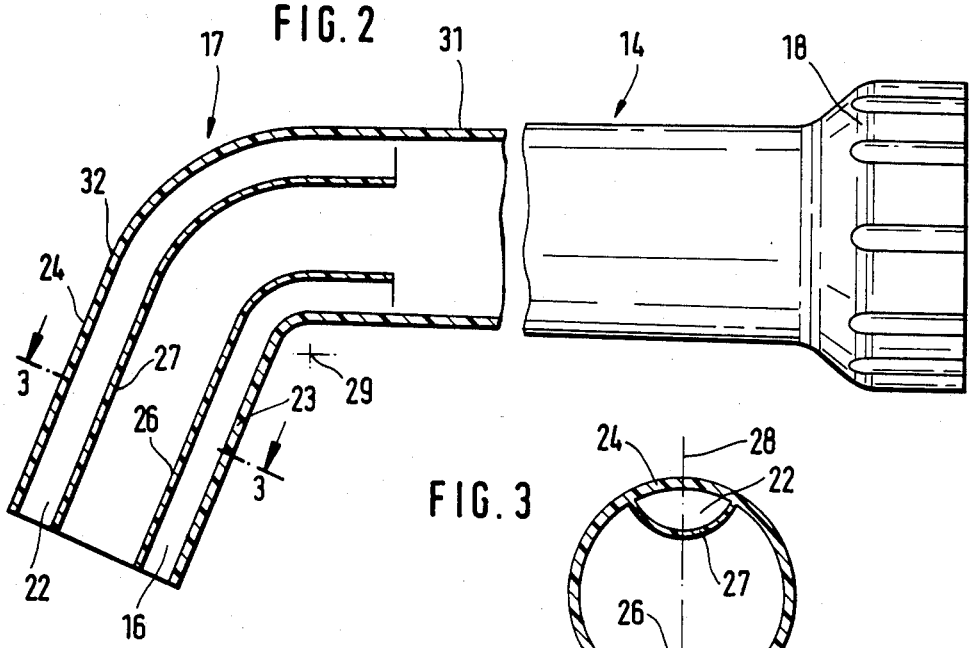
FIG. 2 shows a lateral elevation, partially in section, of a pourer pipe according to the invention.
Figure 3:
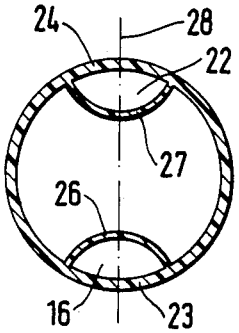
FIG. 3 shows a cross-section through the pourer pipe in the plane 3—3 according to FIG. 2.

In contrast thereto the pourer pipe 14, which will be described in greater detail below with reference to FIGS. 2 and 3, is usable in the position as illustrated without sacrifice of function, because then a further vent passage 16 comes to lie uppermost and the separation of outflowing fuel and inflowing air is ensured by it, at least in the critical end part 17. The pourer pipe 14 is provided with a single-start internal threading in the region of its decuring end 18 and fitted therewith on a correspondingly externally threaded pourer spout 19 or a can 21. Due to the fact that an only single-start thread is provided it is ensured that only the position as shown in FIG. 1 can be set between can 21 and pourer pipe 14, in which then the pourer spout also lies at the lowermost point of the can 21 when tilted up, and thus renders its complete emptying possible.

The pourer pipe 14 will now be explained in greater detail with reference to FIGS. 2 and 3. Beside the details mentioned above, in the region of the end part 17 a further vent passage 22 is provided which according to FIG. 3 lies opposite to the vent passage 16. Each of the vent passages 16, 22 is formed on the one part by a sector 23, 24 of the outer wall of the pourer pipe 14, for the other part by an inwardly domed partition 26, 27 issuing therefrom. The vent passages 16 and 22 are here arranged symmetrically in relation to the plane 28 of symmetry of the pourer pipe, which lies in the plane of the drawing in FIG. 2. The sector 23 faces the geometrical centre 29 of the crank of the end part 17. The cross-section of each vent passage 16, 22 occupies in each case about 20% of the pipe cross-section.

The straight part 31 of the pourer pipe 14 possesses, from the crank to the securing end 18, a length of about 20 cm. The end part 32 protruding at an angle has a length of about 4 cm. from the crank and includes with the straight part 31 an angle of about 110°. The straight part 31 here has an external diameter of about 3 cm. with an external wall thickness of about 2 mm. The end part 32 protruding at an angle has an external diameter of about 2.5 cm. and likewise an external wall thickness of about 2 mm. The partitions 26 and 27 have a wall thickness of about 1 mm. The vent passages 16, 22 reach at least approximately from the exit end of the end part 17 to about 2 cm. beyond the crank into the straight part 31. The entire pourer pipe is produced in a manner known per se as an injection moulding from synthetic plastics material.

Figure 4A:
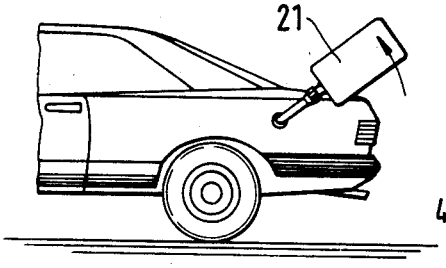
FIG. 4*a* shows diagrammatically a can with pourer pipe in a partially tilted-up position together with a motor car.

In using a can with attached pourer pipe, firstly the can is held so that the pourer pipe protrudes upwards. In this position the end part is pushed into the filler pipe of a car for example, so that when the can can be tilted upwards in the direction of the arrow as indicated in FIG. 4*a*. If it is intended to discharge the entire content of the can, it must be tilted further into the vertical position as entered in FIG. 4*b*.

Figure 4B:
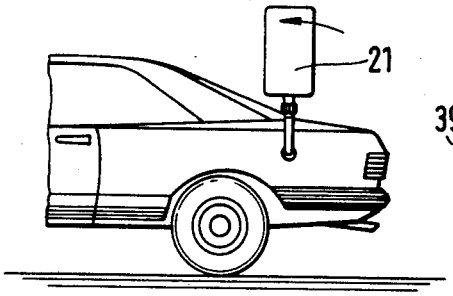
FIG. 4*b* shows an illustration corresponding to FIG. 4*a* with can tilted up vertically.

With the cross-sectional configuration as visible from FIG. 3 therefore the vent passage 16, as shown in FIG. 1, will become fully effective only when the can 21 has reached the vertical position as shown in FIG. 4*b*.

The effect of the two opposite vent passages 16 and 22 is best illustrated if the drawing sheet with FIG. 1 is turned through 90° in the clockwise direction. Thus, one obtains a course of the filler pipe 11 as it was made predominantly hitherto, approaching the vertical. In this case, the vent passage 22 lies upwards and fulfills the function of flow stabilization. Thus, the pourer pipe 14 is universally usable.

Figure 5A:
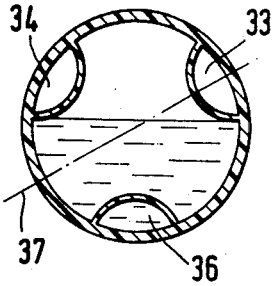
FIG. 5*a* shows a cross-section corresponding to FIG. 3 according to a first further development of the invention and in an operating position corresponding to FIG. 4*a*.
Figure 6A:
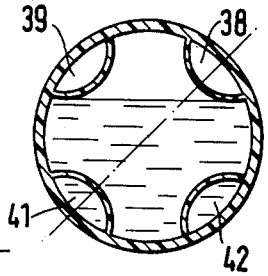
FIG. 6*a* shows a cross-section corresponding to FIG. 3 according to a second further development of the invention and in an operating position corresponding to FIG. 4*a*.
Figure 5B:
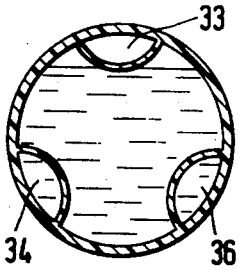
FIG. 5*b* shows a cross-section corresponding to FIG. 5*a* in an operating position corresponding to FIG. 4*b*.
Figure 6B:
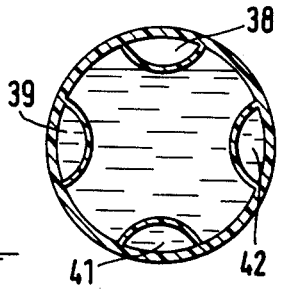
FIG. 6*b* shows the cross-section according to FIG. 6*a* in an operating position corresponding to FIG. 4*b*.

FIGS. 5*a* and 5*b* show a cross-sectional form modified in comparison with FIG. 3, namely with a total of three vent passages 33, 34 and 36, the vent passage 33 being arranged symmetrically in relation to a plane 37 of symmetry of the pourer pipe. This has the consequence that in the filling position as represented in FIG. 4*a* the vent passages 33 and predominantly 34 are effective, provided that the liquid level in the region of the angled-off end part does not exceed the level indicated diagrammatically in FIG. 5*a*. In comparison therewith a cross-sectional configuration as illustrated in FIGS. 6*a* and 6*b* with four vent passages 38, 39, 41 and 42 permits a somewhat higher liquid level and thus faster emptying of the can in an intermediate position corresponding to FIG. 4*a*. In the can position corresponding to FIG. 4*b* in each of the two forms of embodiment one vent passage, namely 33 and 38 respectively, is in the uppermost and only effective position. The other air passages, like the remainder of the space of the pourer pipe, conduct the liquid. In this case, however, due to the separation of the liquid flow by zones an additional stabilizing effect also occurs, since in no case can the liquid flowing in the vent passages 34, 36 or 39, 41 and 42 be perturbed by the air flowing in the opposite direction.

In the case of larger cans, of about 20 liters capacity, it can be regarded as expedient if the can 21 is held mainly in the position visible in FIG. 4*a*, in order to be tilted up briefly exclusively for emptying the final remainder. Then it is advisable to make the arrangement of the vent passages such that there is an exchange of the positions of FIGS. 5*a* and 5*b* or 6*a* and 6*b* in relation to the can positions of FIGS. 4*a* and 4*b* respectively. The distribution of the vent passages in the pipe cross-section consequently is determined, in accordance with the above, according to the position of a can in which it is held predominantly in the emptying of the liquid.

I claim:

1. Pourer pipe for fitting on a can in the 5 to 20 liter range, having an outer wall, a securing end, a rigid, angled end part which can be introduced into the filler pipe of another container, and at least one vent passage in the end part in the region of the outer wall; comprising the improvement wherein at least one additional vent passage is formed at least in the angled end part, the vent passages are each formed from a sector of the outer wall and an inwardly domed partition issuing therefrom, the cross-section of each vent passage occupies about 10 to 30% of the pipe cross-section, the pourer pipe has a straight part extending from the bend of the angled end part to the securing end, which has a length of about 18 to 22 cm., the angled end part has a length of about 3 to 7 cm., and the straight part extends from the angled end part at an angle of about 110°.

2. Pourer pipe according to claim 1, wherein the vent passages are arranged at least approximately symmetrically in the pipe cross-section.

3. Pourer pipe according to claim 2, wherein three vent passages are provided.

4. Pourer pipe according to claim 2, wherein four vent passages are provided.

5. Pourer pipe according to one of claims 3 or 4, wherein the pourer pipe has a plane of symmetry and at least one of the vent passages is arranged symmetrically in relation to the plane of symmetry.

6. Pourer pipe according to claim 1, wherein the cross-section of each vent passage occupies about 15 to 20% of the pipe cross-section.

7. Pourer pipe according to claim 1, wherein the pourer pipe has a securing end lying opposite to the angled end part, which comprises a single-start internal threading for attachment to a pouring spout with corresponding external threading, on a can.

8. Pourer pipe according to claim 1, wherein the straight part has an external diameter of about 3 cm. with an external wall thickness of about 1 to 2 mm.

9. Pourer pipe according to claim 8, wherein the angled end part has an external diameter of about 2.5 cm. with an external wall thickness of about 1 to 2 mm.

10. Pourer pipe according to claim 9, wherein the vent passages have partition walls having a wall thickness of 0.5 to 1.5 mm.

11. Pourer pipe according to claim 1, wherein the vent passages extend at least approximately from the outlet end of the angled end part to about 2 to 6 cm. beyond the bend of the angled end part.

12. Pourer pipe according to claim 1, wherein the pourer pipe is composed of injection-molding synthetic plastic material.

* * * * *